US009713760B2

(12) United States Patent
Peacock et al.

(10) Patent No.: US 9,713,760 B2
(45) Date of Patent: Jul. 25, 2017

(54) MARKER CONE SYSTEM

(71) Applicants: Joshua C. Peacock, Walnut Creek, CA (US); Jacob A. Peacock, Castro Valley, CA (US)

(72) Inventors: Joshua C. Peacock, Walnut Creek, CA (US); Jacob A. Peacock, Castro Valley, CA (US)

( * ) Notice: Subject to any disclaimer, the term of this patent is extended or adjusted under 35 U.S.C. 154(b) by 129 days.

(21) Appl. No.: 14/865,297

(22) Filed: Sep. 25, 2015

(65) Prior Publication Data

US 2016/0090702 A1 Mar. 31, 2016

Related U.S. Application Data

(60) Provisional application No. 62/055,992, filed on Sep. 26, 2014.

(51) Int. Cl.
*A63K 3/04* (2006.01)
*E01F 9/00* (2016.01)
(Continued)

(52) U.S. Cl.
CPC ..... *A63C 19/062* (2013.01); *A63K 3/043* (2013.01); *E01F 9/692* (2016.02); *A63B 69/002* (2013.01);
(Continued)

(58) Field of Classification Search
CPC ..... E01F 9/00; E01F 9/60; E01F 9/623; E01F 9/677; E01F 9/681; E01F 9/688;
(Continued)

(56) References Cited

U.S. PATENT DOCUMENTS 1,888,565 A * 11/1932 O'Rourke ..... G09F 7/08 40/607.1
2,014,290 A * 9/1935 Pohlman ..... G09B 27/08 248/188.1
(Continued)

FOREIGN PATENT DOCUMENTS

CA 2778672 A1 * 11/2013 ..... E01F 9/692
CH 391977 A * 5/1965 ..... E04H 12/2238
WO WO 8301470 A1 * 4/1983 ..... E01F 9/692

OTHER PUBLICATIONS

PCT International Search Report and Opinion Received from Korean Intellectual Property Office for PCT/US2015/052297; Received and Printed Dec. 17, 2015.

*Primary Examiner* — Richard A Smith
(74) *Attorney, Agent, or Firm* — Neustel Law Offices

(57) ABSTRACT

A marker cone system which provides users with greater spatial awareness and guidance when using marker cones for sports training or other sports and/or non-sports related activities. The marker cone system generally includes a weight which may be installed underneath the marker cone and a post receiver which may be installed within the channel of a marker cone. The post receiver and weight will generally be connected together, such as by threaded engagement, with the marker cone being secured therebetween. A marker post may be removably inserted within the post receiver to improve visibility or provide additional functionality. The marker post may include a slot to reduce wind resistance and one or more receiver openings adapted to removably receive cross members. By utilizing multiple marker posts with post receivers, one may construct a hurdle, fence, goal, or any number of structures for sports or non-sports applications.

20 Claims, 9 Drawing Sheets

(51) Int. Cl.

| | |
|---|---|
| ***A63C 19/06*** | (2006.01) |
| ***E01F 9/692*** | (2016.01) |
| *A63B 69/00* | (2006.01) |
| *A63B 71/02* | (2006.01) |

(52) U.S. Cl.
CPC ..... *A63B 69/0028* (2013.01); *A63B 2071/026* (2013.01); *A63B 2210/50* (2013.01)

(58) Field of Classification Search
CPC ..... E01F 9/692; A63C 19/00; A63C 19/062; A63K 3/04; A63K 3/043; A63B 69/00; A63B 69/002; A63B 69/0028; A63B 2071/026; A63B 2210/50
USPC ..... 116/63 R, 63 P; 40/602, 607.04, 607.1, 40/607.11
See application file for complete search history.

(56) References Cited

U.S. PATENT DOCUMENTS

| | | | | |
|---|---|---|---|---|
| 2,263,138 | A | 11/1941 | Olson | |
| 4,269,534 | A | 5/1981 | Ryan | |
| 4,511,281 | A | 4/1985 | Schmanski | |
| 5,348,291 | A * | 9/1994 | Scully | A63B 63/00 473/454 |
| 5,421,668 | A | 6/1995 | Cowan | |
| 5,485,700 | A | 1/1996 | Van Vranken | |
| 5,497,972 | A | 3/1996 | Sofy | |
| 5,908,262 | A * | 6/1999 | Ahn | E01F 9/675 116/63 P |
| 6,065,233 | A * | 5/2000 | Rink | G09F 15/0037 211/205 |
| 6,113,054 | A | 9/2000 | Ma | |
| 6,446,930 | B1 | 9/2002 | Li | |
| 6,564,489 | B1 * | 5/2003 | Bader | G09F 15/0062 116/63 P |
| 6,769,380 | B1 | 8/2004 | Carvajalino | |
| 2007/0117659 | A1 * | 5/2007 | Best et al. | A63B 71/023 473/474 |
| 2008/0295375 | A1 | 12/2008 | Intagliata | |
| 2012/0196725 | A1 | 8/2012 | Burrell | |
| 2012/0269575 | A1 | 10/2012 | Dag | |
| 2013/0236247 | A1 | 9/2013 | Kunkel | |

* cited by examiner

MARKER CONE SYSTEM

CROSS REFERENCE TO RELATED APPLICATIONS

I hereby claim benefit under Title 35, United States Code, Section 119(e) of U.S. provisional patent application Ser. No. 62/055,992 filed Sep. 26, 2014. The 62/055,992 application is currently pending. The 62/055,992 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to an improvement to marker cones and more specifically it relates to a marker cone system which provides users with greater spatial awareness and guidance when using marker cones for sports training or other sports and/or non-sports related activities.

Description of the Related Art

Any discussion of the related art throughout the specification should in no way be considered as an admission that such related art is widely known or forms part of common general knowledge in the field.

Marker cones are well known in the art and have been in use for years for various purposes; typically related to outdoor activities such as sports or track. Typical marker cones merely comprise a cone which is laid on the ground to mark off an area, such as the bounds of a goal or a finish line. However, these existing marker cones can often be difficult to view; particularly for an individual who is in the heat of a workout, sport, or game.

Because of the inherent problems with the related art, there is a need for a new and improved marker cone system which allows a lightweight, durable post to be easily connected and disconnected from most marker cones to provide users with greater spatial awareness and guidance when using marker cones for sports training or other sports and/or non-sports related activities.

BRIEF SUMMARY OF THE INVENTION

Provided herein is an improvement for marker cones which includes a weight which may be installed underneath the marker cone and a post receiver which may be installed within the channel of a marker cone. The post receiver and weight will generally be connected together, such as by threaded engagement, with the marker cone being secured therebetween. A marker post may be removably inserted within the post receiver to improve visibility or provide additional functionality. The marker post may include a slot to reduce wind resistance and one or more receiver openings adapted to removably receive cross members. By utilizing multiple marker posts with post receivers, one may construct a hurdle, fence, goal, or any number of structures for sports or non-sports applications.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
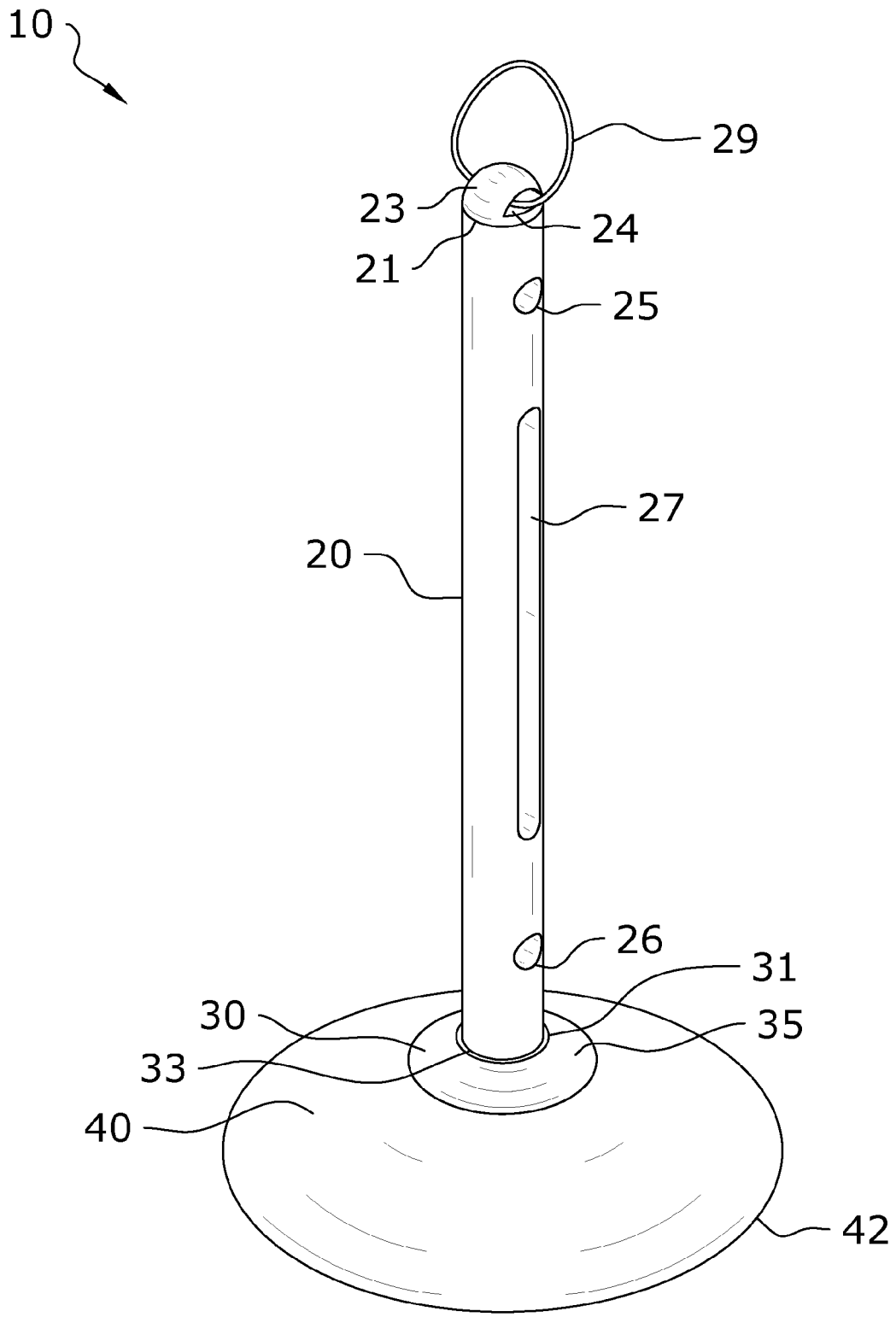
FIG. 1 is an upper perspective view of the present invention.
Figure 2:
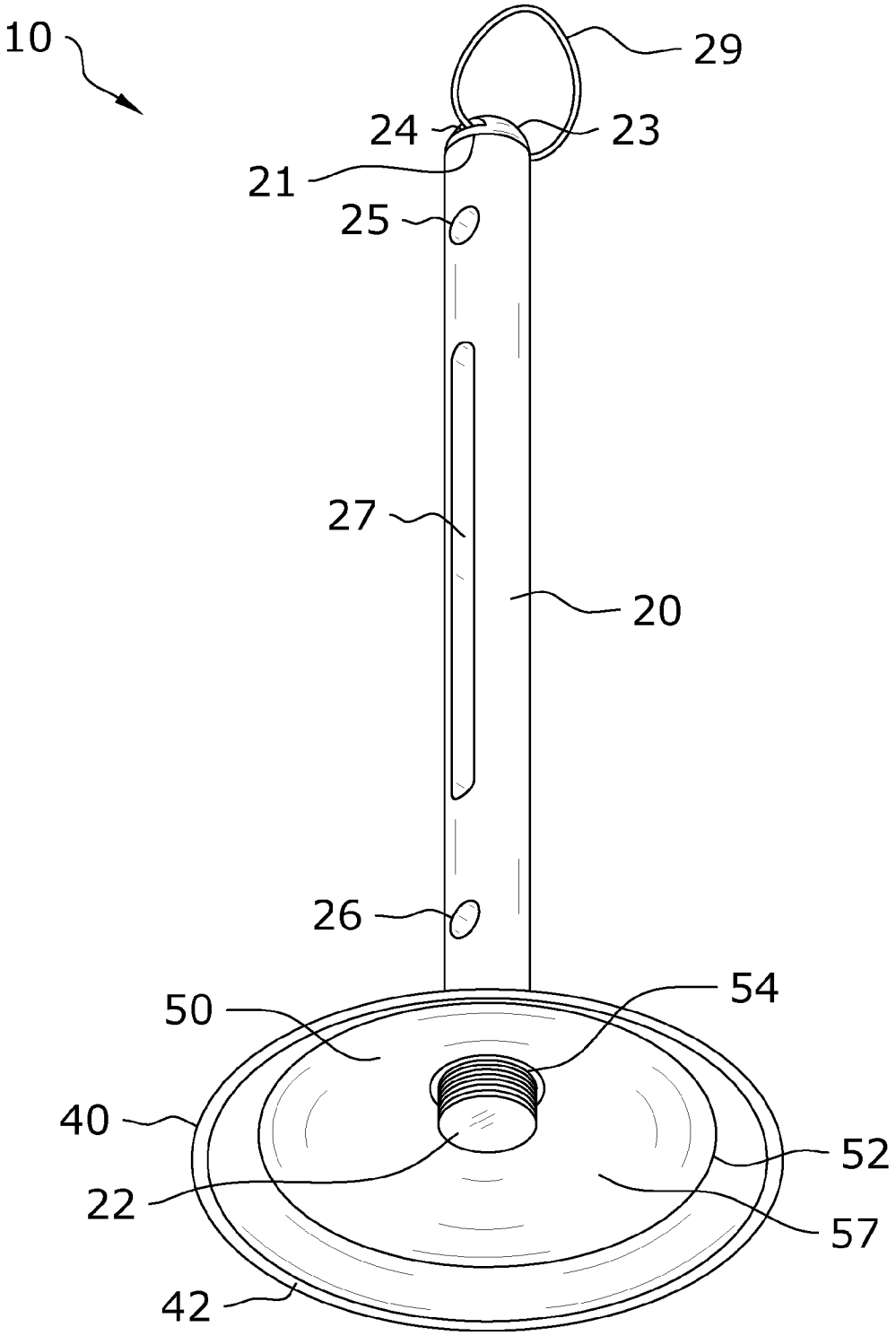
FIG. 2 is a lower perspective view of the present invention.

A. Overview.

The present invention provides a new way for coaches, athletic trainers, athletes, or any other user to mark a field or define an area for sports or other non-sports related activities. The present invention allows the user to quickly add height to a marker cone 30 when desired. The shape and materials are crafted to provide a secure connection between the lower end 22 of the marker post 20 and the post receiver 30 so that the marker post 20 extends upwardly from a marker cone 40. This is advantageous in that users can utilize the marker post 20 to add height to a marker cone 40 to enhance the visual effect and functionality of the marker cones 40.

Figure 5:
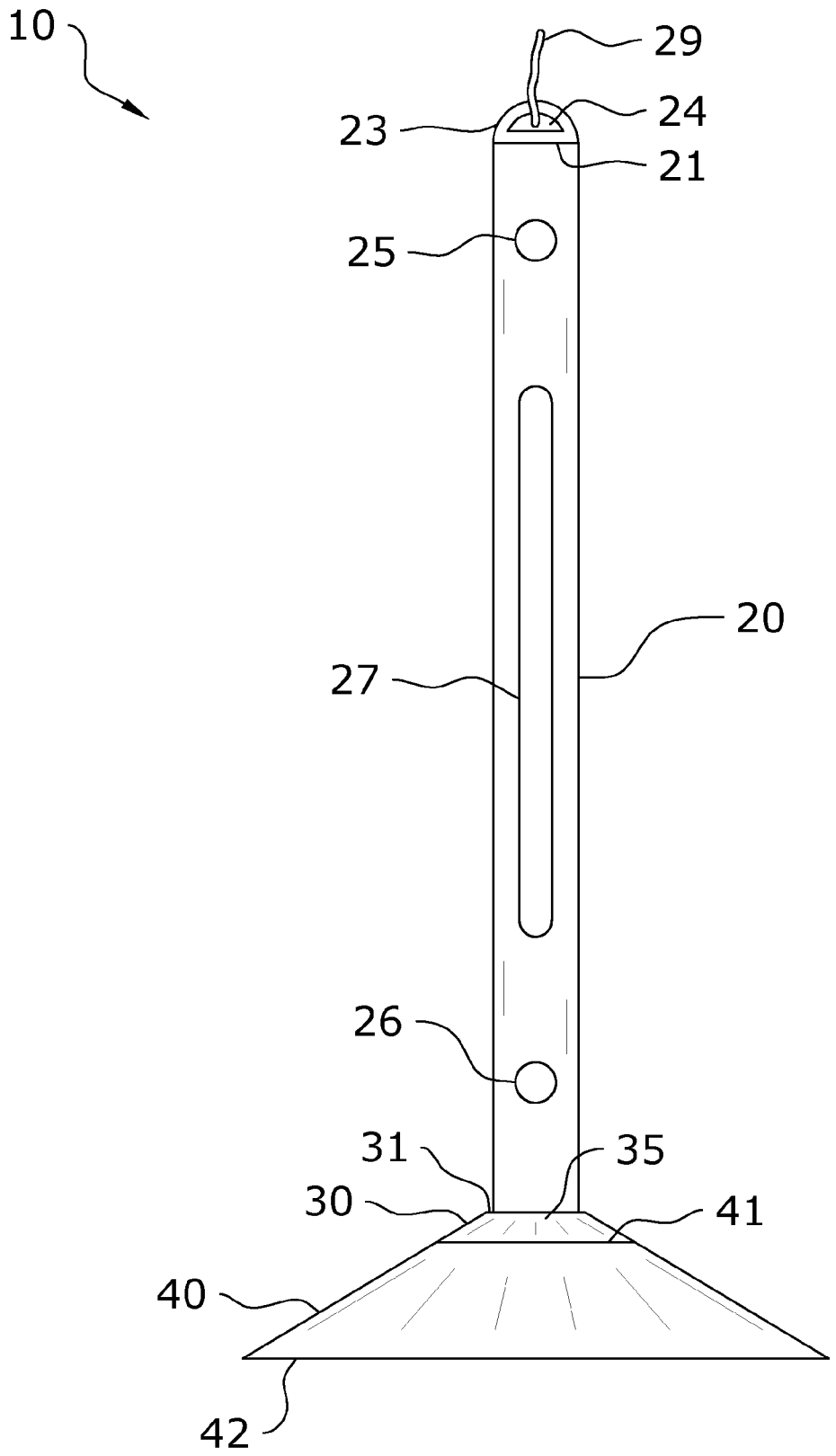
FIG. 5 is a frontal view of the present invention.
Figure 6:
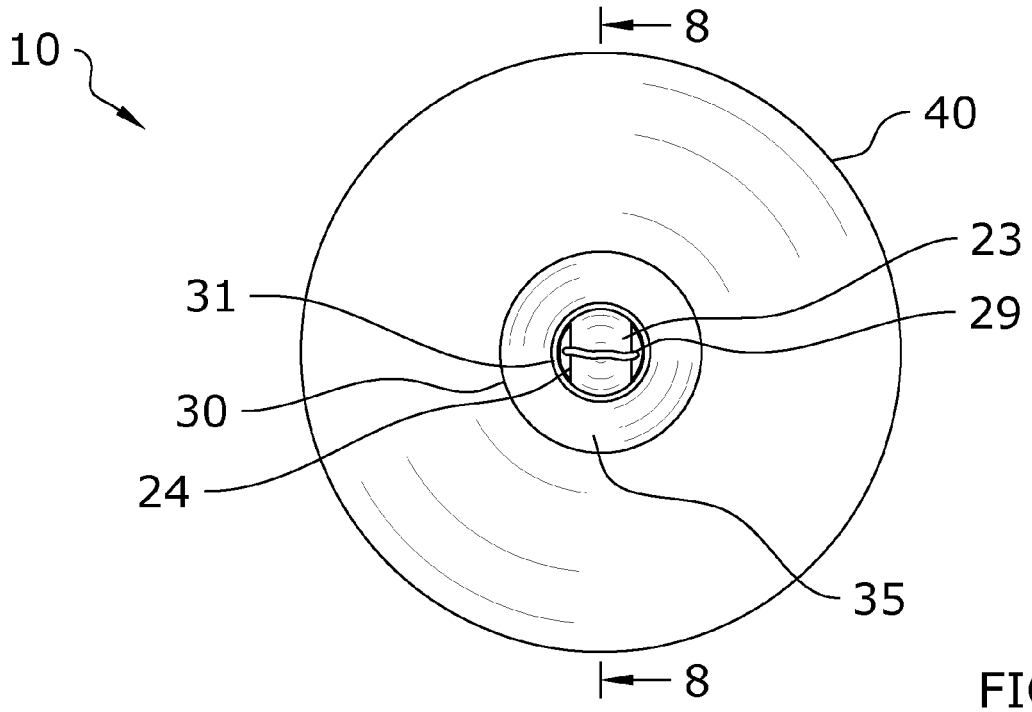
FIG. 6 is a top view of the present invention.
Figure 7:
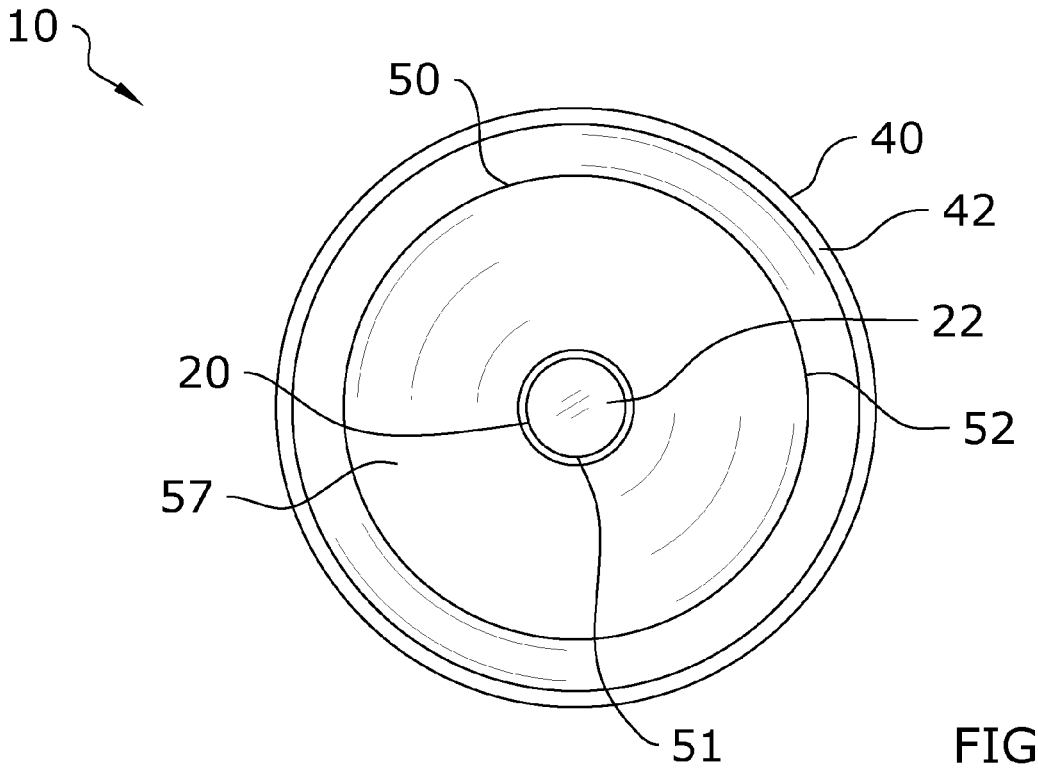
FIG. 7 is a bottom view of the present invention.
Figure 10:
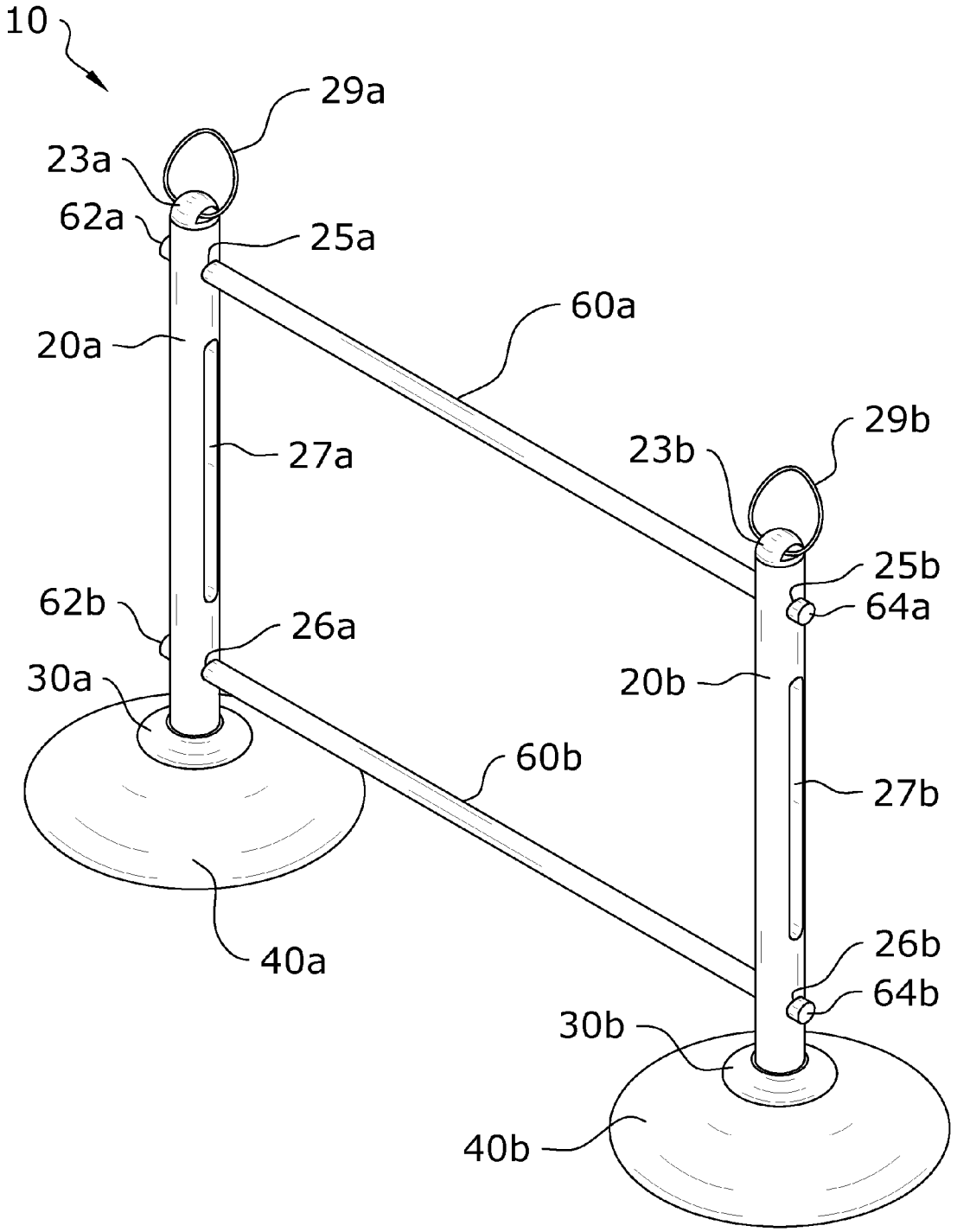
FIG. 10 is an upper perspective view of a hurdle configuration of the present invention.

FIG. 5 illustrates side view of the marker post 20. The overall shape of the marker post 20 is a round elongated structure of various widths and heights depending on the application. The lower end 22 of the marker post 20 is constructed such that a secure connection may be made with the post receiver 30. This allows the marker post 20 to extend upwardly from a marker cone 40, thus improving visibility and functionality of the marker cone 40. There is a handle opening 24 at the upper end 21 (although the handle opening 24 could be made at the lower end 22 also) of the marker post 20 to allow a handle 29 such as a lanyard to be attached to the marker post 20 for easy carrying. Receiver openings 25, 26 are utilized to allow one or more cross members 60, generally comprised of poles, to be inserted between two marker posts 20*a,b* to create a hurdle configuration if desired as shown in FIG. 10.

Figure 3:
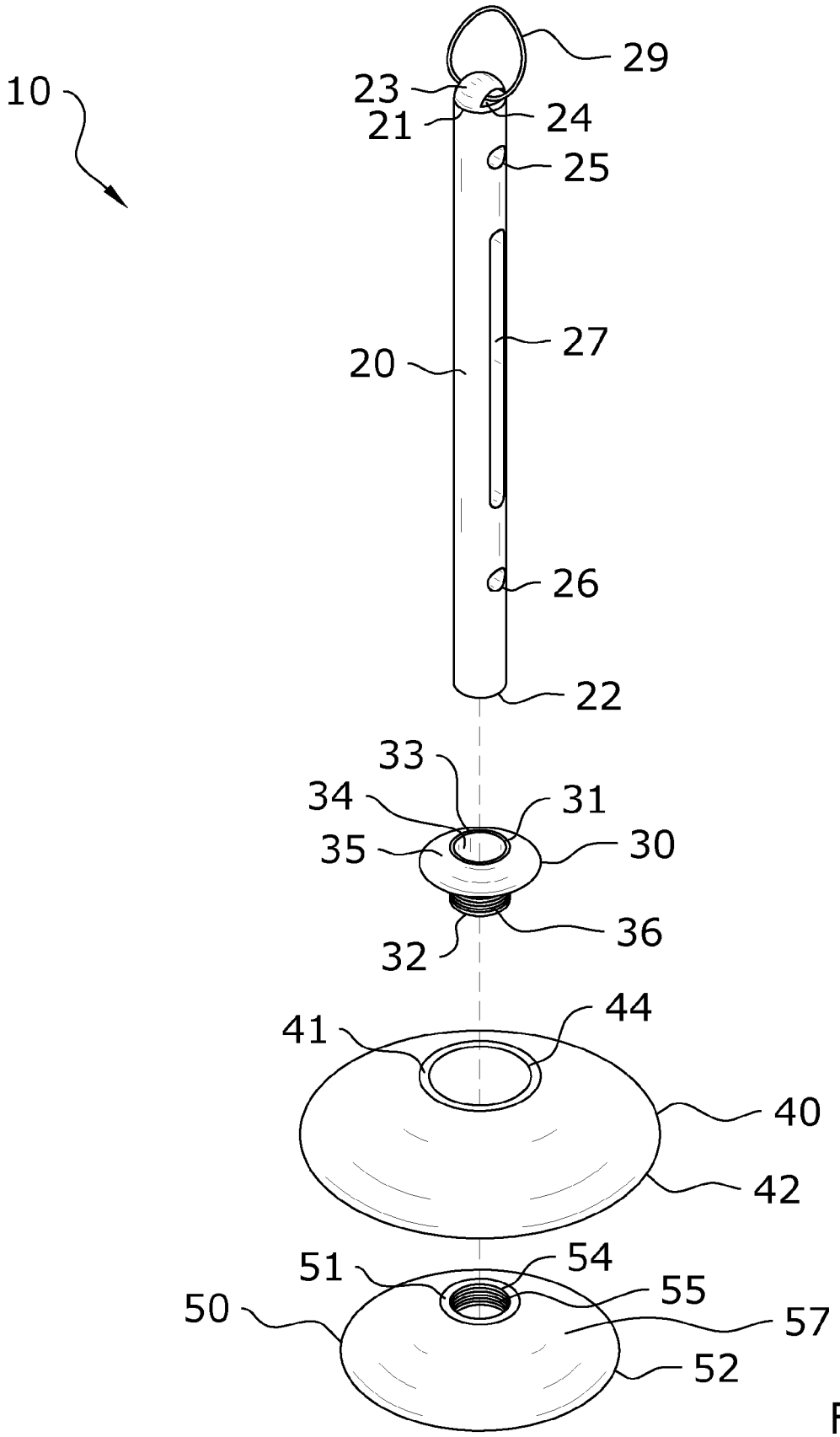
FIG. 3 is an exploded side perspective view of the present invention.

FIG. 3 illustrates the post receiver 30. A collar 35 rests on top of the post receiver 30 to help make a secure connection with the marker cone 40. This collar 35 prevents the post receiver 30 from falling through the opening 44 of the marker cone 40. There are threads 36 on the outside area of the post receiver 30 that is inserted into the opening 44 on the upper end 41 of a marker cone 40 to allow a secure connection with the weight 50 (alternatively, this outside area may be smooth and connect via the weight 50 being pressed onto the post receiver 30 instead of by threads 36). The top view shows the post receiver 30 may comprise a circular structure. The top view further shows: (1) a collar 35 which helps provide a secure connection with the marker cone 40, (2) that the outside area of the post receiver 30 under the collar 35 is threaded 36, and (3) the channel 33 inside the post receiver 30 which receives the marker post 20. The channel 33 inside the post receiver 30 is smooth, but may have a retainer portion 34 comprised of a tacky material to improve connection with the marker post 20. This channel 33 is where the marker post 20 mates with the post receiver 30 to provide a snug fit.

Figure 8:
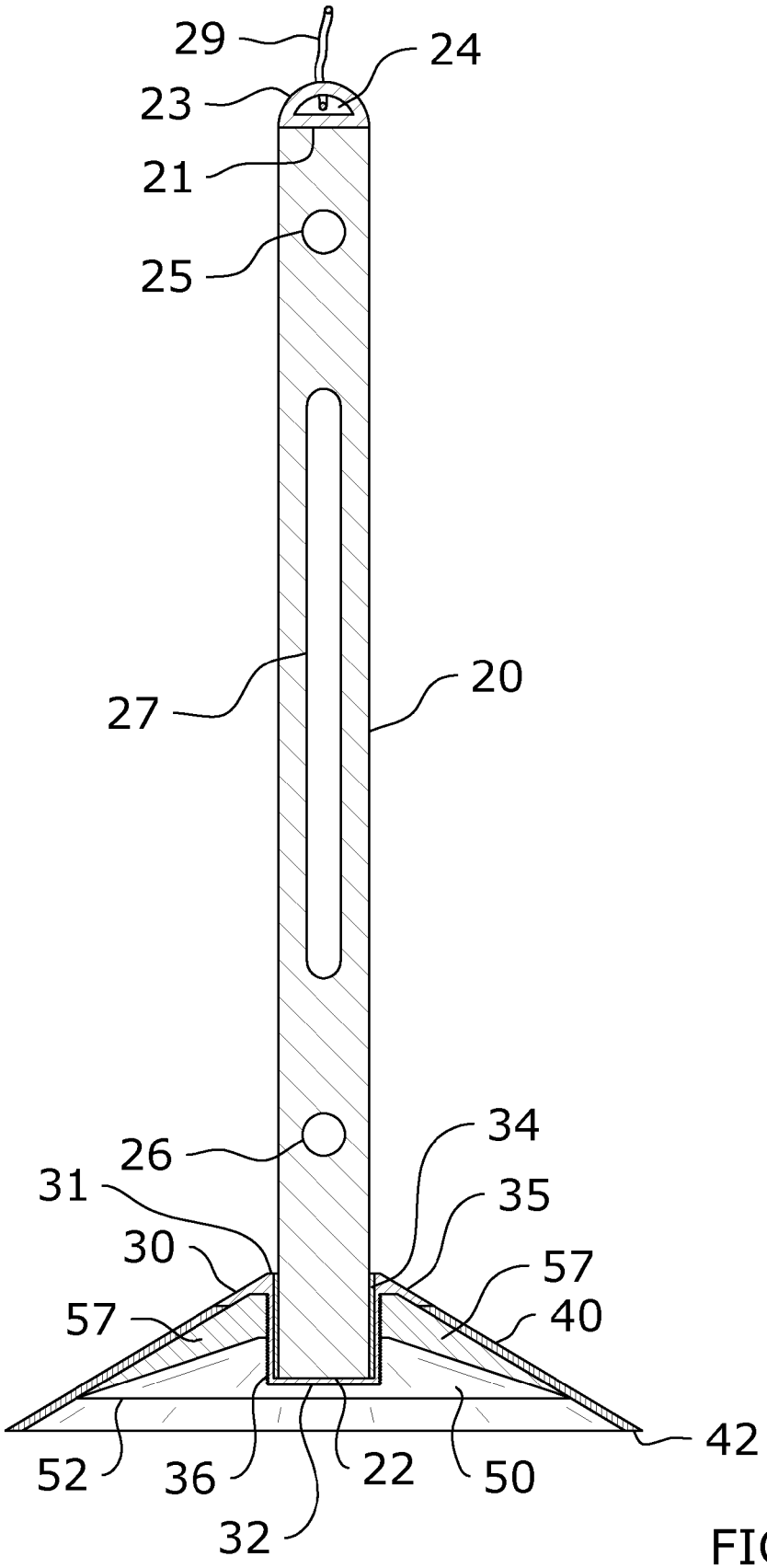
FIG. 8 is a frontal sectional view of the present invention.

FIG. 3 provides a view of the weight 50. The view shows an opening 54 which is threaded 55 (although it may be smooth and connect via being pressed onto the post receiver 30 instead of by threads 55) on the inside area of the opening 54 so that it may be attached to the post receiver 30 making a secure connection. The view also shows the weighted area 57 designed to rest along the contours of the underside of a marker cone 40 to make a secure connection. The view shows the weight 50 may comprise a circular structure. The view of FIG. 8 shows the weighted area 57 that is designed to rest along the contours of the lower end 42 of a marker cone 40 to provide a secure connection and maintain the marker cone's 40 ability to nest or stack when carried. There is an opening 54 which allows for connection to the post receiver 30, which includes its own threading 36.

FIG. 8 shows a side view of how the post receiver 30 and the weight 50 are to be used together to provide a secure connection to a marker cone 40. The post receiver 30 is placed on top of the marker cone 40 with the collar 35 resting outside of the marker cone 40 and the threading 36 inside the opening 44 of the marker cone 40. The weight 50 is inserted into the lower end 42 of a marker cone 40 and the inner threaded area 55 of the weight 50 is attached to the outer threaded area 36 of the post receiver 30. As the post receiver 30 and the weight 50 come together, they make a secure connection to the marker cone 40. When so configured, the marker cone 40 can then be used with or without the marker post 20.

FIG. 8 shows a side view of how the marker post 20, the post receiver 30, the marker cone 40, and the weight 50 would be used to make the secure connection. The post receiver 30 would be placed on top of the marker cone 40 with the hollow column extending through the opening 44 of the marker cone 40. The user would then attach the weight 50 to the post receiver 30 from underneath the marker cone 40. Once a secure connection is made between the post receiver 30, the marker cone 40, and the weight 50, then the marker post 20 can be inserted into the post receiver 30 so that the marker post 20 would extend upwards from the marker cone 40 to add height, increase visibility, and improve functionality.

FIGS. 5 and 8 show a side view of how the marker post 20, the post receiver 30, the marker cone 40, and the weight 50 would look when all components were used in operation. From the side you would only see the marker post 20, the post receiver 30 collar, and the marker cone 40. The threaded portions 36, 55 of the post receiver 30 and the weight 50 would not be seen from the side view as they would be underneath the marker cone 40 (as illustrated with the dotted-lines). If the marker post 20 were removed, then the marker cone 40 with the post receiver 30 and the weight 50 attached could still be used in any manner that a marker cone 40 is currently used. This feature allows a user to decide when added height or increased visibility is beneficial, and to quickly add this feature when desired by the user.

FIG. 8 shows a side view and cut-out of the marker post 20, post receiver 30, marker cone 40, and the weight 50 when connected. The main body of the marker post 20 extends upwards from the marker cone 40. The collar 35 of the post receiver 30 would rest on top of the marker cone 40. The threaded area 36 of the post receiver 30 would be inserted through the opening 44 of the marker cone 40 and extend underneath the marker cone 40 where it would be connected to the weight 50, as seen in the cut-out. The weight 50 would follow the contours of the marker cone 40 to make a secure connection with the post receiver 30 and the marker cone 40.

It should be appreciated that the present invention, in an alternative design, may comprise a marker cone 40 with an integral post receiver 30. The marker cone 40 would be of similar design to what is already in production; except that it includes an integral post receiver 30. The post receiver 30 may have a weighted area to add stability to the design. There is an opening 44 at the top of the marker cone 40 to receive a marker post 20. The marker cone 40 with integrated post receiver 30 could be used with or without a marker post 20 attached. The marker cone 40 with integrated post receiver 30 will be constructed in a way to allow for them to nest or stack with other marker cones 40. The marker cone 40 with integrated post receiver 30 may be of circular design. When looking at the design from the bottom, you see the marker cone 40, the built-in weighted section 57 of the post receiver 30, and the opening 44 to receive marker post 20.

The lower end of the marker post 20 would be inserted into the opening 44 of the marker cone 40 with integrated post receiver 30 in such a way that the main body of the marker post 20 would extend upwards from the marker cone 40 with integrated post receiver 30. The integrated post receiver 30 will be constructed in such a way to add stability to the marker cone 40. The marker cone 40 with integrated post receiver 30 can be used with or without a marker post 20.

The main body of the marker post 20 would extend upwards from the marker cone 40 with integrated post receiver 30. The marker cone 40 with integrated post receiver 30 has a weighted area 57 underneath to add stability and accept the marker post 20. The opening 44 of the marker cone 40 with integrated post receiver 30 is where the marker post 20 is inserted to make a secure connection. The bottom end 22 of the marker post 20 is inserted into the opening 44 of the marker cone 40 with integrated post receiver 30 to make a secure connection. The weighted area 57 helps add stability. The marker post 20 can be quickly and easily connected or disconnected depending on the user's needs.

B. Marker Post.

As shown throughout the figures, the present invention generally comprises a marker cone system 10 which is adapted to augment and improve existing marker cones 40 to improve visibility and add new functionality, such as easy transition into a hurdle configuration as shown in the figures.

An exemplary marker post 20 of the present invention is shown in FIGS. 1-5. As shown therein, the marker post 20 will generally comprise of elongated member having an upper end 21 and a lower end 22. The upper end 21 of the marker post 20 may include a handle opening 24 through which a handle 29 such as a lanyard may be removably or fixedly secured. The handle 29 will aid in transporting the marker post 20 to different locations while in use. The upper end 21 of the marker post 20 may include a removable cap portion 23, or may comprise an integral structure.

As best shown in FIG. 5, the marker post 20 may include a pair of receiver openings 25, 26 adapted to receive a cross member 60, such as to form a hurdle configuration as shown in the figures. While the figures merely illustrate a first receiver opening 25 and a second receiver opening 26, it should be appreciated that more or less receiver openings 25, 26 may be utilized in different embodiments of the present invention.

The receiver openings 25, 26 may be positioned at various locations along the length of the marker post 20 and thus the positioning of the receiver openings 25, 26 shown in the figures should not be construed as limiting on the scope of the present invention. Similarly, the orientation, size, and configuration of the receiver openings 25, 26 may also vary depending on the intended application of the present invention.

FIG. 5 also provides a view of an exemplary slot 27 included in the marker post 20. The slot 27 is provided to reduce or eliminate wind resistance of the marker post 20. By allowing wind to flow through the slot 27 of the marker post 20, the stability of the marker post 20 in inclement weather may be greatly improved. Without the slot 27, the marker post 20 would be more susceptible to tipping over due to wind. The size, orientation, and configuration of the slot 27 may vary, but the slot 27 will preferably extend along the length of the marker post 20 between its upper and lower ends 21, 22 as shown in the figures.

C. Post Receiver.

FIG. 3 provides an exemplary illustration of a post receiver 30 for use with the present invention. The post receiver 30 is adapted to interconnect with the marker cone 40 to allow the marker post 20 to be connected thereto. In some embodiments, the post receiver 30 may be integrally formed with the marker cone 40. In other embodiments such as shown in the figures, the post receiver 30 may comprise a discrete structure which is removably connected to the marker cone 40.

Figure 4:
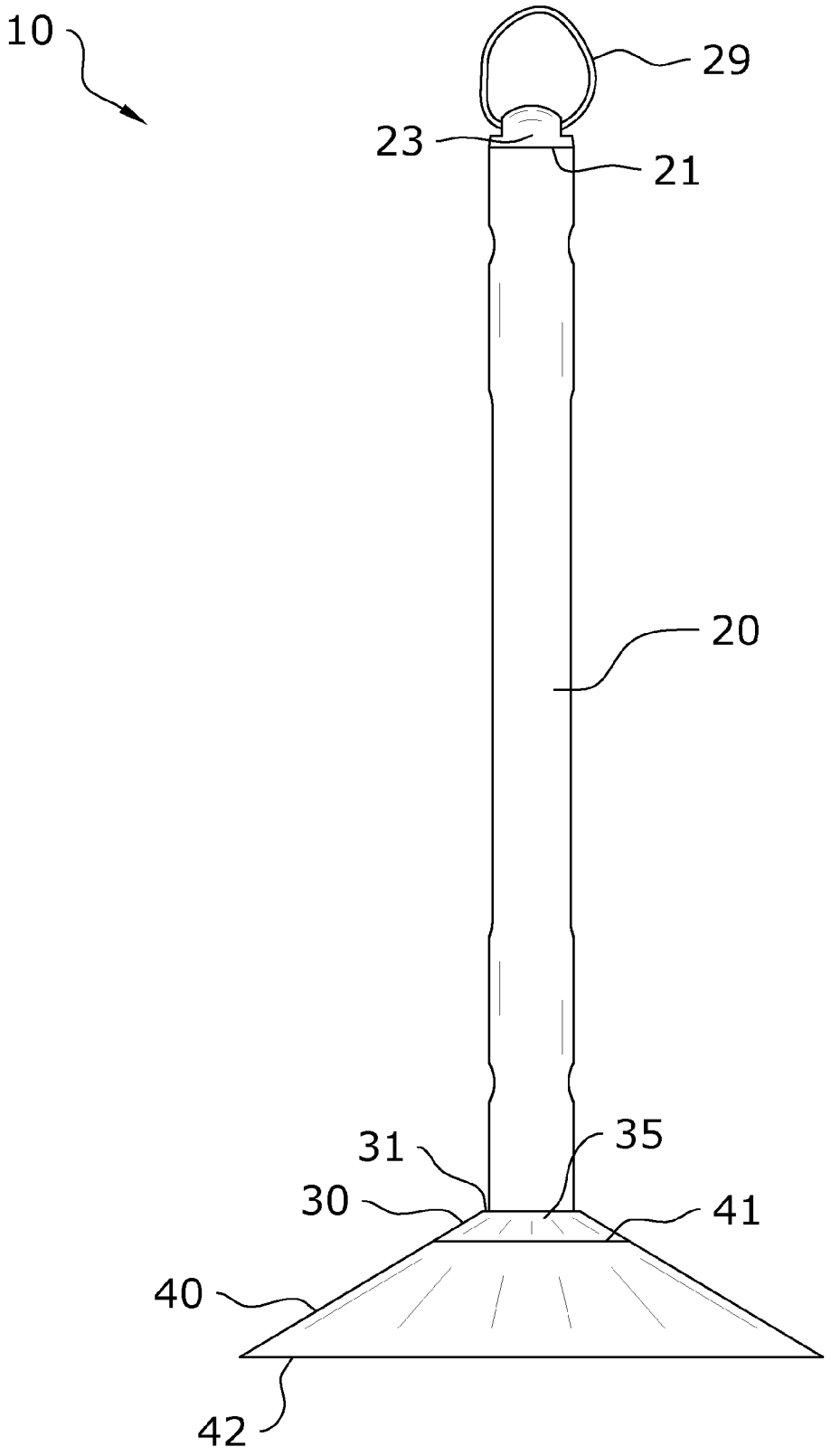
FIG. 4 is a side view of the present invention.

The post receiver 30 will generally comprise an upper end 31 and a lower end 32, with a channel 33 extending fully through the post receiver 30 between its upper and lower ends 31, 32. The post receiver 30 is adapted to connect to the upper end 41 of the marker cone 40, such as by resting within the opening 44 of the marker cone 40 as shown in FIG. 4. The post receiver 30 preferably includes a collar 35 which retains the post receiver 30 in position on top of the marker cone 40. The collar 35 will generally rest on the upper end 41 of the marker cone 44 in the area surrounding its opening 44.

The lower end 32 of the post receiver 30 may comprise a tubular structure extending downwardly from the collar 35 as shown in the figures. The lower end 32 will generally include threading 36 which is adapted to engage with similar threading 55 on the weight 50 to interconnect the post receiver 30, marker cone 40, and weight 50 together as shown throughout the figures. In some embodiments, this threading 36 may be omitted and, instead, frictional fit, adhesive, or other securing methods may be utilized.

D. Marker Cone.

An exemplary marker cone 40 is shown throughout the figures. Marker cones 40 are generally known in the art and typically comprise an upper end 41 and a lower end 42, with an opening 44 in the upper end 41 of the marker cone 40. The shape, size, and configuration of the marker cone 40 may vary widely in different embodiments of the present invention. The present invention is thus adapted for use with a wide range of marker cones 40.

E. Weight.

As shown throughout the figures, the present invention may utilize a weight 50 which aids in weighting down the marker cone 40 to improve its stability during use. The weight 50 may be integrated with the marker cone 40 in some embodiments. In the embodiments shown in the figures, the weight 50 comprises a discrete structure which is connected to the post receiver 30 and marker cone 40 of the present invention. The weight 50 may comprise a heavy material or may comprise another material with a weighted portion 57 comprising a heavy material.

Figure 9:
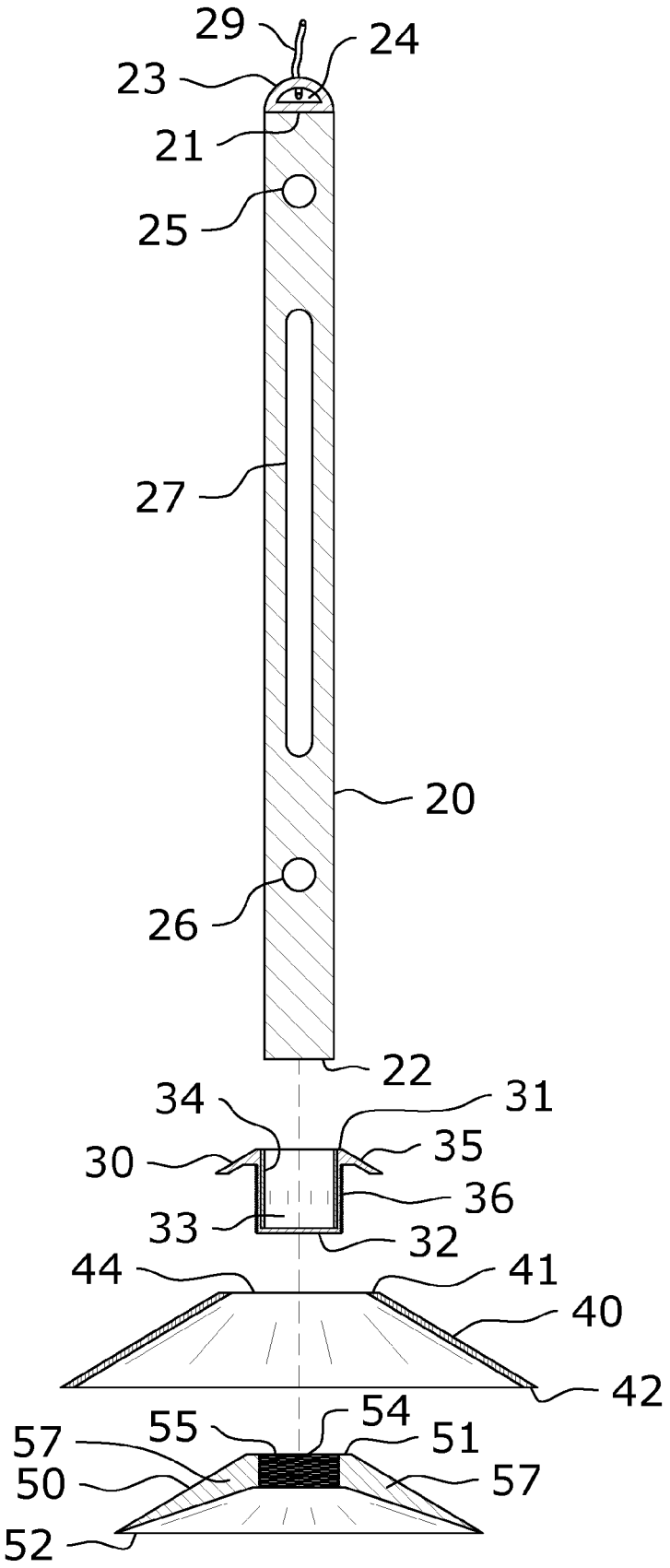
FIG. 9 is a frontal sectional exploded view of the present invention.

The weight 50 of the present invention is best shown in FIG. 9. As shown, the weight 50 comprises an upper end 51 and a lower end 52, with an opening 54 in the upper end 51 to receive the post receiver 30. The opening 54 will generally include threading 55 adapted to engage with the threading 36 on the post receiver 30 to connect the post receiver 30 to the weight 50, with the marker cone 40 being sandwiched between the post receiver 30 and weight 50.

F. Cross Members.

FIG. 10 illustrates the present invention being utilized as a hurdle with the use of a pair of cross members 60. The cross members 60 will generally comprise poles which are removably connected between a pair of marker posts 20 to form the hurdle. It should be appreciated that, in some embodiments, the cross members 60 may comprise ropes or other elongated members. In some embodiments, netting may be utilized to form a goal. It should be appreciated that any number of marker posts 20 may be interconnected together to form various structures, including the hurdle shown, a gate, a fence, a goal, or the like.

G. Operation of Preferred Embodiment.

In use, the marker cone 40 is first connected between the post receiver 30 and the weight 50. The weight 50 may be positioned underneath the lower end 42 of the marker cone 40, with the opening 54 of the weight 50 being aligned with the opening 44 of the marker cone 40. A preferred method would be to position the weight 50 flat on the ground and then place the marker cone 40 over the weight 50 to cover the weight 50 completely as shown in the figures. After doing so, the opening 44 at the upper end 41 of the marker cone 40 will provide full access to the opening 54 of the weight 50, including the threading 55 of the opening 54.

With the weight 50 positioned underneath the marker cone 40, the post receiver 30 may be installed. It is notable that, in some embodiments, the post receiver 30 may be integrally formed with the marker cone 40 and thus the following steps may be omitted. In the embodiment shown in the figures, the post receiver 30 is lowered onto the upper end 41 of the marker cone 40, with the lower end 32 of the post receiver 30, generally comprising a tubular member with threading 36, extending through the opening 44 of the marker cone 40 to be secured to the corresponding threading on the interior surface of the opening 54 of the weight 50. Thus, the post receiver 30 may be connected to the weight 50 directly, with the marker cone 40 being sandwiched between the post receiver 30 and the weight 50. The connection of the two threaded portions 36, 55 will ensure that neither the post receiver 30, the marker cone 40, nor the weight 50 become disconnected during use.

The marker cone 40 may then be utilized for various functionality, with the weight 50 ensuring stability during use. If desired, the marker post 20 may be removably inserted into the post receiver 30 via its channel 33. A retainer portion 34 within the channel 33 may be provided to frictionally secure the marker post 20 within the post receiver 30.

Once the marker post 20 is connected to the marker cone 40 as described, a user can place the combined unit wherever they require increased visibility for sports training, or non-sports situations. In sports training applications, users may create slalom courses, goals, boundaries, hurdles, etc. in a way that increases visual awareness for athletes. In non-sports applications, users can effectively bring attention to areas that they want to mark for any reason (i.e., parking areas, no-entry areas, areas requiring caution, etc.).

If the user wants to create a hurdle configuration for training drills, two marker cones 40 with attached marker posts 20 may be aligned. One or more cross members 50 may be inserted into the receiver openings 25, 26 of the respective marker posts 20 such that the cross members 50 are perpendicular with respect to the marker posts 20 and parallel with respect to the ground surface. A hurdle could also be utilized in specific situations to create passing arcs, or other such targets for certain athletic drills (i.e., soccer passing).

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A marker post system, comprising:

a marker cone including an upper end, a lower end, and an opening in said upper end;

a post receiver extending through said opening of said marker cone; and a weight positioned underneath said marker cone, wherein said post receiver is connected to said weight.

2. The marker post system of claim 1, wherein said post receiver comprises a collar adapted to rest on said upper end of said marker cone.

3. The marker post system of claim 2, wherein said post receiver comprises a threaded lower end, wherein said threaded lower end fits within said opening of said marker cone.

4. The marker post system of claim 3, wherein said weight includes a threaded opening.

5. The marker post system of claim 4, wherein said threaded lower end of said post receiver is removably connected to said threaded opening of said weight.

6. The marker post system of claim 1, further comprising a marker post removably inserted within a channel of said post receiver.

7. The marker post system of claim 6, wherein said marker post includes a slot for reducing wind resistance of said marker post.

8. The marker post system of claim 7, wherein said marker post includes at least one receiver opening.

9. The marker post system of claim 8, further comprising at least one cross member, wherein said at least one cross member is removably inserted within said at least one receiver opening.

10. The marker post system of claim 9, wherein said at least one cross member comprises an elongated pole.

11. A marker post system, comprising:

a marker cone including an upper end, a lower end, and an opening in said upper end;

a post receiver removably connected within said opening of said marker cone, wherein said post receiver includes a channel;

a weight secured against said lower end of said marker cone, wherein said post receiver is connected to said weight; and a marker post removably inserted within said channel of said post receiver.

12. The marker post system of claim 11, wherein said marker post includes a handle.

13. The marker post system of claim 11, wherein said marker post includes a vertical slot for reducing wind resistance of said marker post.

14. The marker post system of claim 11, wherein said post receiver comprises an upper end and a lower end, wherein said upper end of said post receiver includes a collar.

15. The marker post system of claim 14, wherein said lower end of said post receiver comprises a first threaded portion.

16. The marker post system of claim 15, wherein said opening of said weight comprises a second threaded portion.

17. The marker post system of claim 16, wherein said first threaded portion removably engages with said second threaded portion.

18. The marker post system of claim 11, wherein said marker post comprises a first receiver opening, a second receiver opening, and a vertical slot.

19. The marker post system of claim 18, wherein said first receiver opening is above said vertical slot and wherein said second receiver opening is below said vertical slot.

20. The marker post system of claim 19, further comprising a first cross member removably inserted within said first receiver opening and a second cross member removably inserted within said second receiver opening.

* * * * *